US006224740B1

(12) United States Patent
Gestermann et al.

(10) Patent No.: US 6,224,740 B1
(45) Date of Patent: May 1, 2001

(54) ELECTROLYSIS PROCESS

(76) Inventors: Fritz Gestermann, Berliner Str. 83, 51377 Leverkusen; Hans-Dieter Pinter, Forstring 20, 42929 Wermelskichen; Helmut Ziegler, Im Wiedenhof 5 a, 51429 Bergisch-Gladbach, all of (DE)

( * ) Notice: Subject to any disclaimer, the term of this patent is extended or adjusted under 35 U.S.C. 154(b) by 0 days.

(21) Appl. No.: 09/587,309

(22) Filed: Jun. 5, 2000

(30) Foreign Application Priority Data

Jun. 12, 1999 (DE) ..... 199 26 887

(51) Int. Cl.[7] ..... C25B 1/34
(52) U.S. Cl. ..... 205/536; 205/762; 204/290.14
(58) Field of Search ..... 205/536, 762; 204/290.14

(56) References Cited

U.S. PATENT DOCUMENTS 5,028,302 * 7/1991 Rutherford ..... 205/536
5,746,896 5/1998 Shimamune et al. ..... 204/284

FOREIGN PATENT DOCUMENTS 35 43 379 6/1987 (DE) .
196 22 744 7/1997 (DE) .

OTHER PUBLICATIONS

Journal of Applied Electrochemistry vol. 22 (month unavailable) 1992, pp. 699–704, F. Hine, "Combination of the Amalgam Cell and the Membrane Cell Process for Chlor–Alkali Production".

* cited by examiner

*Primary Examiner*—Arun S. Phasge
(74) *Attorney, Agent, or Firm*—Joseph C. Gill; Lyndanne M. Whalen

(57) ABSTRACT

The invention relates to a process for the electrolysis of sodium chloride-containing brine with parallel operation of amalgam electrolysis units (5) and membrane electrolysis units (4) with a common brine circuit using a mercury-resistant oxygen consumable cathode in the membrane electrolysis unit (4).

14 Claims, 1 Drawing Sheet

ELECTROLYSIS PROCESS

The invention relates to a process for the parallel operation of amalgam electrolysis units and membrane electrolysis units with a common brine circuit using a mercury-resistant oxygen consumable cathode in the membrane electrolysis unit.

The oxygen consumable cathode for use in NaCl electrolysis is known in principle from the literature. For its operation, for example in a pressure-compensated arrangement, as described in DE 19622744 C1, brine in the conventional membrane cell quality is employed. In order to protect the cathode activation, this brine is kept free from mercury.

The mercury contamination of the NaCl brine known for chloro-alkali electrolysis by the amalgam method is typically from about 10 mg/l to 400 mg/l in normal operation or as a peak value after shut-down of the unit.

It is known of common membrane electrolysis units that mercury, in particular in the above-mentioned high concentration, results in relatively rapid passivation of the cathode coating (cathode material) by mercury ions migrating through the membrane from the anode space. This results in an irreversible increase in the voltage for operation of the electrolysis unit and requires greater energy input. Parallel operation of classical amalgam electrolysis units and membrane electrolysis units with a common brine circuit is therefore not possible, apart from the alternative of carrying out complex mercury removal (precipitation) from the brine intended for the membrane electrolysis unit or alternatively constructing a separate, mercury-free brine circuit. Both variants are associated with high complexity.

Attempts to develop mercury-resistant cathode activations have not brought the hoped-for success, and consequently mercury-free brine must continue to be used as the starting point for full utilization of the energy saving. This is usually carried out via separate brine circuits or mercury precipitation using $Na_2S$. Both routes are complex processes.

A further aspect plays an important role in the case of step-wise conversion from amalgam electrolysis to the membrane method: if the energetically less favourable, mercury-resistant cathode activation is to be used during parallel operation of amalgan and membrane methods, with the aim, after complete refitting, of changing over to the optimum, but mercury-sensitive cathode activation, the entire brine and lye circuit must first be rendered totally mercury-free, which causes enormous problems, especially as some of the mercury in the lye circuit may be in metallic form.

The object was therefore, based on the known prior art, to provide an electrolysis process in which an amalgam electrolysis and a membrane electrolysis, preferably using an oxygen consumable cathode, can be operated in parallel with the same brine circuit. The process is to have the advantages of known processes with oxygen consumable cathodes.

The object is achieved in accordance with the invention by the use in a membrane electrolysis process of oxygen consumable cathodes which are resistant to the effects of mercury. The object is furthermore achieved by the use of a Ca/Mg ion exchanger which reduces the Ca/Mg content, even in the case of mercury-containing brine, to <20 ppb, which is necessary in order to ensure the full service life of the membranes.

Figure 1:
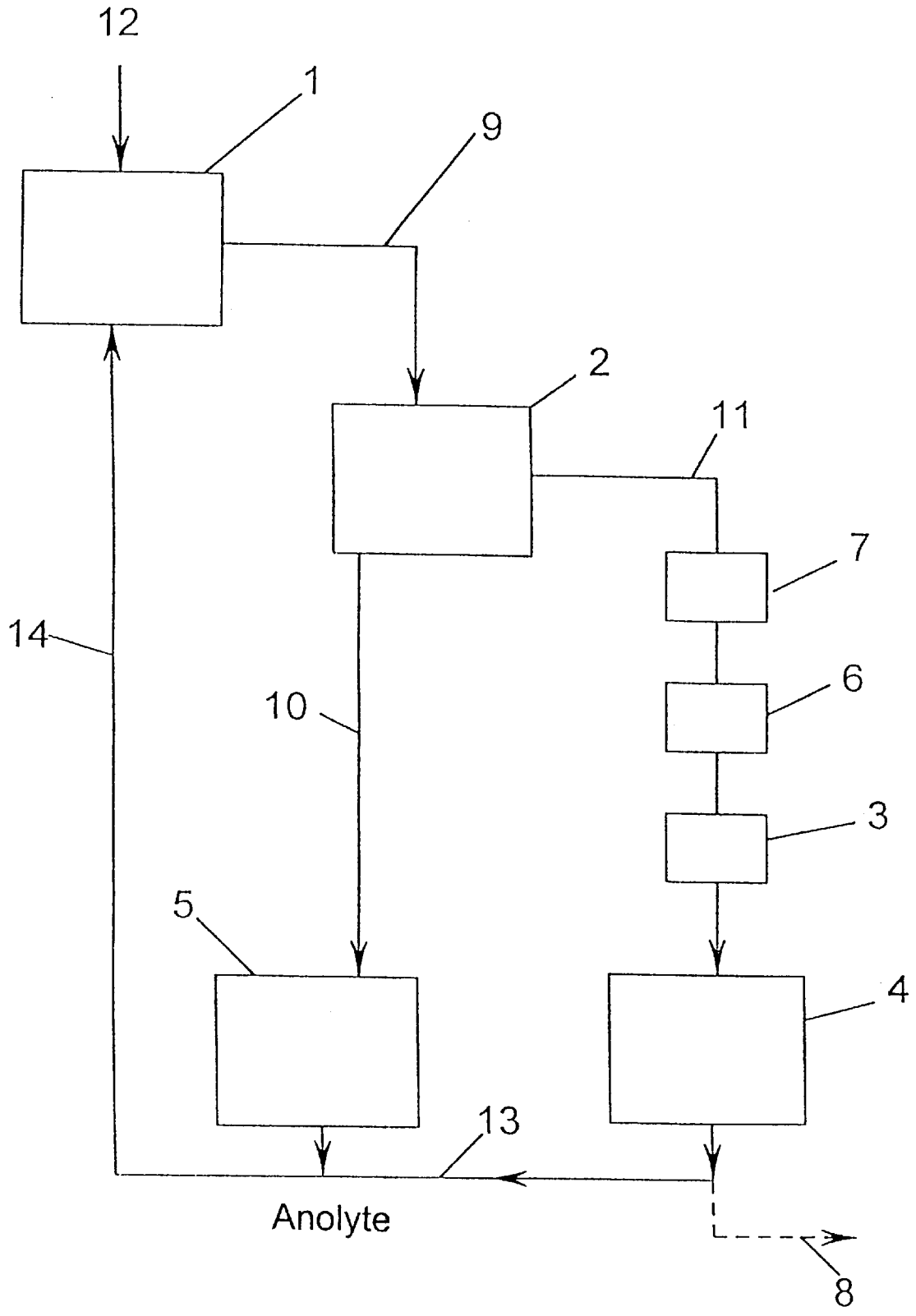
FIG. 1 illustrates a reaction scheme for the process of the present invention in which membrane electrolysis with an oxygen consumable cathode and amalgam electrolysis are carried out in parallel.

The invention relates to a process for the electrolysis of sodium chloride-containing brine with parallel operation of amalgam electrolysis units and membrane electrolysis units with a common brine circuit, comprising the steps:

- feeding of the brine from a salt dissolution station to a precipitation and filter station, and coarse removal of sulphate, calcium and magnesium ions from the brine in the precipitation and filter station,
- division of the brine into a main stream and a sub-stream, electrolysis of the main stream of the brine in an amalgam electrolysis unit,
- pre-treatment of the brine sub-stream by removal of free chlorine in a dechlorination station, precipitation of, in particular, Al, Fe and Mg ions in a hydroxide precipitation station, and, if appropriate, removal of calcium and magnesium ions from the brine,
- subsequent electrolysis of the brine sub-stream in a membrane electrolysis unit, and combination of the anolyte streams from the membrane electrolysis unit and the amalgam electrolysis unit to form a joint anolyte stream, where a membrane electrolysis unit having a mercury-resistant oxygen consumable cathode is used.

The oxygen consumable cathode has the following structure:

The metallic support for distribution of the electrons consists of a mesh of silver wire or silver-plated nickel wire or another lye-resistant alloy, for example Inconel, which should likewise be silver-plated or otherwise treated in order to avoid oxide or hydroxide layers of poor conductivity. The use of a deep-structured support, such as, for example, felt made from fine fibres of the above-mentioned mesh material, is particularly advantageous. The catalyst matrix consists of the known mixture of Teflon for establishing hydrophobicity and porosity for gas diffusion, an electrically conductive support, for example of vulcan black or acetylene black, and the catalyst material itself finely divided therein, which is mixed-in in the form of catalytically active silver particles. The catalyst matrix is sintered or pressed with the support. Alternatively, the carbon components (carbon black) can be omitted if the catalyst density and/or the hydrophobic support which has been rendered conductive have been established in such a way that the predominant amount of the catalyst particles are also electrically contacted.

As an alternative, the carbon black can be omitted in the oxygen consumable cathode, so that the electrode matrix consists only of Teflon and silver, where the silver, besides the catalyst function, also takes on the job of electron conduction, and correspondingly a sufficiently high Ag loading is necessary for the particles to touch one another and form conductive bridges with one another. The support used here can be either the wire mesh, a fine expanded metal, as known from battery technology, or a felt made from silver, silver-plated nickel or silver-plated lye-resistant material, for example Inconel steel. It is essential that the silver catalyst is stable toward mercury.

Further preferred prerequisites for parallel operation of amalgam and membrane electrolysis with oxygen consumable cathodes are the maintenance of the sulphate content at <5 g/l, which can be established by means of a corresponding procedure, for example continuous or discontinuous removal of the sulphate by precipitation or alternatively sub-stream precipitation, for, example with addition of $CaCO_3$, $BaCl_2$ or $BaCO_3$, or alternatively, in particular in the case of very low-sulphate salts, by removing a sub-stream of the depleted brine. Another possibility is nanofiltration of the brine or of a brine sub-stream by means of ion-selective membranes in the feed before the membrane electrolysis unit, or alternatively another separation method, for example by means of ion exchangers. It is important that only the sub-stream to the membrane electrolysis unit is set to said sulphate ion concentration, with the side-effect that the main stream also gradually sets itself to a lower content in the circuit.

The $SiO_2$ content in the NaCl brine can easily be kept at <5 ppm by avoiding exposed concrete surfaces in the brine bunker.

The invention gives rise to the following advantages, inter alia:

The silver catalyst in the matrix of carbon black and Teflon present in the oxygen consumable cathode preferably used is clearly totally insensitive to mercury.

The amount of mercury migrating through the membrane from the anode space into the cathode space is considerable under certain circumstances and can be recognized from macroscopic amalgam deposits on the cell base. No impairment of the oxygen consumable cathode is observed here.

Mercury peak loads with a concentration of up to 400 mg of Hg/l in the brine are survived without problems by the oxygen consumable cathode operated in the sodium lye behind the membrane.

The usual concentration of 150–200 mg/l of mercury in the case of normal peaks and <10 mg/l of mercury in normal operation does not prevent operation of the oxygen consumable cathode.

Experiments have shown that, in the process according to the invention, operating voltages which are below those of a mercury-free operation can be used for the electrolysis cell. The difference is typically from 30 to 80 mV. The reduction in the operating voltage unexpectedly remains stable over a long operating period (1 year).

The process according to the invention with an oxygen consumable cathode enables parallel operation of classical amalgam electrolysis units and membrane electrolysis units with a common brine circuit without additional treatment of the brine.

The parallel operation of amalgam electrolysis units and membrane electrolysis units with a common brine circuit plays a special role in the conversion from amalgam electrolysis to membrane electrolysis.

The process according to the invention is explained in greater detail below in illustrative terms with reference to FIG. 1.

FIG. 1 shows the scheme of parallel operation of membrane electrolysis with an oxygen consumable cathode and amalgam electrolysis.

EXAMPLES

Example 1

Overall Process

The brine 9 of NaCl 12 which has been concentrated to an operating concentration of from 300 to 320 g/l in the salt dissolution station 1 passes through the common precipitation and filter station 2, in which, depending on the origin of the salt, sulphate, calcium and magnesium are separated off, leaving a residual impurity level which is permissible for amalgam electrolysis:

Fe ~0.12 mg/l

Al ~0.25 mg/l

Ca ~4.5 mg/l

Mg ~0.15 mg/l $SO_4^{2-0}$~7–10 g/l

The precipitation is carried out in the side-stream with 100 mg/l of NaOH and 200 mg/1 of $Na_2CO_3$. Ca, Mg, Fe and only some of the Si and Al precipitate out and are filtered off together. The sulphate level can only be held at from 10 to 15 g/l via the amounts of water from diverse rinsing and process operations to be removed as thin brine. This high level can be tolerated by the amalgam unit.

The brine 9 is fed in the main stream 2 into the amalgam electrolysis 5 which is present. The free chlorine is firstly destroyed in the dechlorination station 7 in the sub-stream 11 to the membrane electrolysis with oxygen consumable cathode 4, and, in particular, the content of Al, Fe and Mg is reduced to the extent necessary for membrane cells in a hydroxide precipitation station 6. Finally, the subsequent fine purification of the brine which is always necessary is carried out by removing the interfering Ca/Mg impurities in the Ca/Mg ion exchanger 3. The following are set:

Al<100 ppb

Fe<200 ppb

Ca+Mg<20 ppb

After leaving the membrane electrolysis 4 with oxygen consumable cathode, this anolyte stream 13 combines with the anolyte stream from the amalgam electrolysis unit 5. The joint anolyte stream 14 is re-concentrated with salt 12 in the salt dissolution station 1.

If the sulphate content can be controlled via moderate removal of brine, this is appropriate in the region of lowest salt concentration in the overall system at the outlet 8 behind the electrolysis cell 4. In favourable cases of particularly good salt quality, this outlet 8 can also hold the level of the ions otherwise to be precipitated out in the hydroxide precipitation 6 below the tolerance limit for membrane electrolysis.

Operation of an Hg-resistant Electrode

An electrode which is suitable for the overall process was tested under laboratory conditions.

A membrane electrolysis cell 4 with an oxygen consumable cathode with an area of 100 $cm^2$ comprising carbon black, Teflon and silver catalyst on silver-plated nickel mesh from NeNora (type ESNS) was operated with mercury-containing NaCl brine. The mercury contamination of the NaCl brine varied between a content of 10 mg/l and 400 mg/l and simulated a mercury level as occurs in typical normal operation from an amalgam electrolysis unit 5 or as a peak value after shut-down of the unit 5.

The electrolysis cell 4 surprisingly exhibited complete mercury tolerance of the oxygen consumable cathode over an operating period of at least 360 days.

The operating voltage of the electrolysis cell 4 under standard conditions (current density: 3 $kA/m^2$; operating temperature: 85° C.; brine concentration: 210 g/l; NaOH concentration: 32% by weight) was from 1.92 to 1.97 volts. Electrolysis cells with oxygen consumable cathodes in all cases exhibited an operating voltage of from 30 to 80 mV higher in mercury-free operation.

After temporary shut-down of the electrolysis cell 4 for operational reasons, where re-use of the oxygen consumable cathode had originally not been expected since blockages by amalgam had formed in the small (2 mm) outlet channels of the cell, it was nevertheless possible for the oxygen consumable cathode of the electrolysis cell 4 to be put back into operation. After cleaning of the oxygen consumable cathode, the electrolysis cell 4 was started with the same cathode as a trial. Surprisingly, the cathode again worked with the same low operating voltage (1.92 V) as before the blockage of the outlet, where, inter alia, sodium lye had also been forced through the oxygen consumable cathode into the gas space of the cell 4. It was possible to operate the cell 4 for at least a further 130 days without problems after the fault.

The example shows that the overall process is facilitated without problems using the electrode described without faults having to be expected due to the mercury content of the brine 9,11.

Example 2

A typical amalgam cell brine 9 having an Hg content of from 7 to 14 mg/l and a Ca loading of 7 mg/l was passed through a Ca/Mg ion exchanger 3 of the TP 208 type from Bayer AG at a brine throughput of 1 or 2 l/h. The bed volume was 100 $cm^3$ at a column diameter of 3.1 cm. The operating temperature was 65° C., and the pH of the brine was 9.5.

The effect of Ca removal with Hg loading was investigated in two test runs: at a throughput of 2 l/h, i.e. 20 bed volumes per hour, the Ca/Mg level was kept below the specified limit of 20 ppb over a through-flow volume of a total of 800 bed volumes. The ion exchanger was then regenerated in accordance with the user instructions. In total, 15 exhaustion and regeneration cycles were carried out. It was found that it was possible to achieve 60% of the exhaustion capacity of from 7 to 9 g/l of Ca+Mg per liter of ion exchanger known from mercury-free operation in stable long-term operation.

On halving of the brine throughput to 1 l/h, i.e. 10 bed volumes per hour, the full exhaustion capacity of from 7 to 9 g/l of Ca+Mg per liter of ion exchanger was achieved, so that the Ca/Mg limit was only exceeded after 1200 bed volumes of brine through-flow and the ion exchanger had to be regenerated. This state was stable over three further exhaustion cycles with same ion exchanger filling.

What is claimed is:

1. A process for electrolysis of a sodium chloride-containing brine in which an amalgam electrolysis unit and a membrane electrolysis unit having an oxygen consumable electrode are operated in parallel with a common brine circuit comprising a) feeding brine from a salt dissolution station to a precipitation and filter station, b) removing sulfate, calcium and magnesium ions from the brine in the precipitation and filter station, c) dividing the brine from b) into
(1) a main stream and
(2) a sub-stream, d) electrolyzing main stream (1) in the amalgam electrolysis unit, e) pre-treating sub-stream (2) in a dechlorination station, f) treating the sub-stream from e) in a hydroxide precipitation station, g) optionally, removing calcium and magnesium ions from the brine of f), h) electrolyzing the brine from f) or g) in a membrane electrolysis unit, i) combining the brine from d) and from h) to form a stream (3) and j) electrolyzing stream (3) in an electrolysis unit having a mercury-resistant oxygen consumable cathode.

2. The process of claim 1 in which an ion exchanger is used to remove the calcium and magnesium ions in g).

3. The process of claim 1 in which aluminum, iron or magnesium ions are removed by precipitation in f).

4. The process of claim 1 in which the oxygen consumable electrode used is composed of (i) at least one electrically conductive metallic, lye resistant support, (ii) a polytetrafluoroethylene catalyst matrix which is sintered or pressed on the support, (iii) an electrically conductive matrix material, and (iv) a catalyst.

5. The process of claim 4 in which conductive support (i) is a mesh, expanded metal, felt made from silver wire, silver-plated nickel or Inconel wire.

6. The process of claim 4 in which the electrically conductive matrix material (iii) is carbon black.

7. The process of claim 4 in which the catalyst (iv) is particulate catalytically active silver or another particulate mercury-compatible catalyst.

8. The process of claim 1 in which the sulfate ion concentration of the brine after treatment in b) is less than 5 grams/liter.

9. The process of claim 8 in which b) is conducted by precipitation with calcium carbonate, barium chloride, barium carbonate or by nanofiltration.

10. The process of claim 1 in which calcium and magnesium ions are removed in b) with a calcium/magnesium ion exchanger.

11. The process of claim 10 in which the calcium/magnesium ion exchange is mercury-resistant.

12. The process of claim 1 in which the calcium and magnesium ion concentrations in the brine of b) are less than 20 parts per billion.

13. The process of claim 1 in which stream (3) from i) is fed back into the salt dissolution station used in a).

14. The process of claim 1 in which the $SiO_2$ content of the brine is less than 5 ppm before electrolysis.

* * * * *